US008881425B2

(12) United States Patent
Latos

(10) Patent No.: US 8,881,425 B2
(45) Date of Patent: Nov. 11, 2014

(54) SYSTEM AND METHOD FOR DRYING WOOD PRODUCTS WITH RECOVERED FLUE GAS

(75) Inventor: Philip Latos, St. Albert (CA)

(73) Assignee: Weyerhaeuser NR Company, Federal Way, WA (US)

( * ) Notice: Subject to any disclaimer, the term of this patent is extended or adjusted under 35 U.S.C. 154(b) by 573 days.

(21) Appl. No.: 12/722,465

(22) Filed: Mar. 11, 2010

(65) Prior Publication Data

US 2011/0219640 A1 Sep. 15, 2011

(51) Int. Cl.
*F26B 3/04* (2006.01)
*F26B 23/02* (2006.01)
*F26B 23/10* (2006.01)

(52) U.S. Cl.
CPC ..... *F26B 23/02* (2013.01); *F26B 23/10* (2013.01); *F26B 2210/16* (2013.01)
USPC ..... 34/427; 34/443; 34/513

(58) Field of Classification Search
USPC ..... 34/443, 487, 492, 513, 514, 86, 209, 34/210, 218, 427
See application file for complete search history.

(56) References Cited

U.S. PATENT DOCUMENTS

| | | | | |
|---|---|---|---|---|
| 3,098,799 | A * | 7/1963 | Crawford | 202/93 |
| 4,194,296 | A * | 3/1980 | Pagnozzi et al. | 34/410 |
| 4,280,878 | A | 7/1981 | Sprenger | |
| 4,414,813 | A | 11/1983 | Knapp | |
| 4,431,405 | A * | 2/1984 | Eatherton | 432/72 |
| 4,467,532 | A * | 8/1984 | Drake | 34/407 |
| 4,663,860 | A | 5/1987 | Beall | |
| 4,888,885 | A * | 12/1989 | Caughey | 34/503 |
| 5,960,558 | A * | 10/1999 | Bourgault | 34/495 |
| 5,970,624 | A * | 10/1999 | Moriya | 34/411 |
| 7,194,822 | B2 | 3/2007 | Kolari | |
| 7,370,434 | B2 | 5/2008 | Duncan | |
| 2006/0101663 | A1 * | 5/2006 | Perin et al. | 34/396 |
| 2006/0272172 | A1 | 12/2006 | Pollard | |
| 2007/0187223 | A1 | 8/2007 | Graham | |
| 2009/0158615 | A1 * | 6/2009 | Muehlboeck | 34/487 |

FOREIGN PATENT DOCUMENTS

JP 2002130951 A * 5/2002

OTHER PUBLICATIONS

Milota, Michael R. and Tschernitz, John L., Simulation of Drying in a Batch Lumber Kiln from Single-Board Tests, Drying Technology, 12(8), 2027-2055 (1994), Marcel Dekker, Inc. US.

Food and Agriculture Organization of the United Nations (FAO), Energy Conservation in the Mechanical Forest Industries, FAO Forestry Paper—93, Chapter 5—The role of design and equipment selection, Rome 1990, ISBN 92-5-102912-1, FAO Corporate Document Repository, http://www.fao.org/docrep/T0269e/t0269e07.htm#5.%20the%20role%20of%20design%20and%20equipment%20selection.

Robertson, Keith, and Pollard, Andy, Windsor Technology, Continuous Drying Kiln—CDK—Technology, May 2003.

* cited by examiner

*Primary Examiner* — Jiping Lu
(74) *Attorney, Agent, or Firm* — Christensen O'Connor Johnson Kindness PLLC

(57) ABSTRACT

Systems and methods are used for drying wood products in one or more kilns with recovered flue gases. In some embodiments, methods for drying wood products include firing a fuel in the one or more combustion devices, thereby producing a heated fluid and a flue gas. The heated fluid is circulated to provide a primary heat source to the one or more indirect fired kilns. An amount of flue gas is recovered and transferred to provide a secondary heat source to the one or more indirect fired kilns.

7 Claims, 6 Drawing Sheets

SYSTEM AND METHOD FOR DRYING WOOD PRODUCTS WITH RECOVERED FLUE GAS

TECHNICAL FIELD

The present disclosure is directed generally to systems and methods for drying wood products in one or more kilns with recovered flue gases.

BACKGROUND

Drying is an important process in wood product manufacturing for a number of reasons including prevention of wood degradation (e.g., mold), reduction of weight for transport, production of a stiffer product, and reduction of fluctuations in dimensional changes. Most wood products are dried in some type of dry kiln. Modern dry kilns provide a controlled temperature and humidity environment and are equipped with fans and vent systems to force air circulation and ventilation.

Dry kilns may be categorized as one of two types: batch dry kilns or continuous dry kilns. In a batch dry kiln, stacked loads of wood products are loaded into the kiln to be dried in a stationary batch process in a single chamber. In a continuous dry kiln, stacked loads of wood products enter the green end of the kiln and are moved forward through multiple drying chambers until exiting the dry end of the kiln. Continuous kilns typically consist of three chambers: one main chamber and two conditioning chambers.

Heat to a kiln may be provided either by indirect means or by direct firing. When a kiln is heated directly, combustion (or flue) gases and/or hot air from a source exterior to the kiln are directed into the kiln. When a kiln is heated indirectly, a source exterior to the kiln typically produces a heated fluid which is circulated in equipment such as a heat exchanger. Both batch kilns and continuous batch kilns feature vent control systems, which let in dry air and discharge hot humid air.

Kiln drying is a high energy consuming process, which can account for approximately 70 to 90 percent of a facility's energy needs; therefore, heat recovery may be an attractive method for reducing a facility's drying energy costs. However, the value of energy saved is largely dependent on the differential temperatures between the exhaust temperature of the combustion unit and the kiln exhaust temperature, the efficiency of the recovery system, and its capital and maintenance costs. Thus, there is a need to develop new systems and methods for drying wood products in kilns.

SUMMARY

The following summary is provided for the benefit of the reader only and is not intended to limit in any way the invention as set forth by the claims. The present disclosure is directed generally towards systems and methods for drying wood products in one or more kilns with recovered flue gases.

In some embodiments, a system for drying wood products using recovered flue gas includes one or more combustion devices and one or more indirect fired kilns. The one or more indirect fired kilns each include one or more chambers, one or more heating zones within each of the one or more chambers, one or more heating elements in the one or more chambers, one or more openings for receiving wood products, and one or more ventilation systems. A flue gas recovery mechanism is configured to deliver flue gas from the one or more combustion devices to the one or more indirect fired kilns before the flue gas exits through the exhaust stack.

Further aspects are directed towards methods for drying wood products with recovered flue gas. In some embodiments, such methods include firing a fuel in the one or more combustion devices, thereby producing a heated fluid and a flue gas. The heated fluid is circulated in the one or more heating elements to provide a primary heat source to the one or more indirect fired kilns. An amount of flue gas is recovered and transferred to the one or more kilns via the one or more of the ventilation systems. The recovered flue gas provides a secondary heat source to the one or more indirect fired kilns.

BRIEF DESCRIPTION OF THE DRAWINGS

The present disclosure is better understood by reading the following description of non-limitative embodiments with reference to the attached drawings wherein like parts of each of the figures are identified by the same reference characters, and are briefly described as follows.

DETAILED DESCRIPTION

The present disclosure describes systems and methods for drying wood products in one or more kilns with recovered flue gases. Certain specific details are set forth in the following description and FIGS. 1, 2, 4, 5, and 6 to provide a thorough understanding of various embodiments of the disclosure. Well-known structures, systems, and methods often associated with such systems have not been shown or described in detail to avoid unnecessarily obscuring the description of various embodiments of the disclosure. In addition, those of ordinary skill in the relevant art will understand that additional embodiments of the disclosure may be practiced without several of the details described below.

In this disclosure, the term "wood" is used to refer to any organic material produced from trees, shrubs, bushes, grasses or the like. The disclosure is not intended to be limited to a particular species or type of wood. The term "wood product" is used to refer to a product manufactured from logs such as lumber (e.g., boards, dimension lumber, headers and beams, timbers, moldings and other appearance products; laminated, finger jointed, or semi-finished lumber (e.g., flitches and cants); veneer products; particle board; wood strand products (e.g., oriented strand board, oriented strand lumber, laminated strand lumber, parallel strand lumber, and other similar composites); or components of any of the aforementioned examples. The term "kiln" is used to refer to any type of thermally insulated chamber or series of chambers in which controlled temperature regimes are produced.

Figure 1:
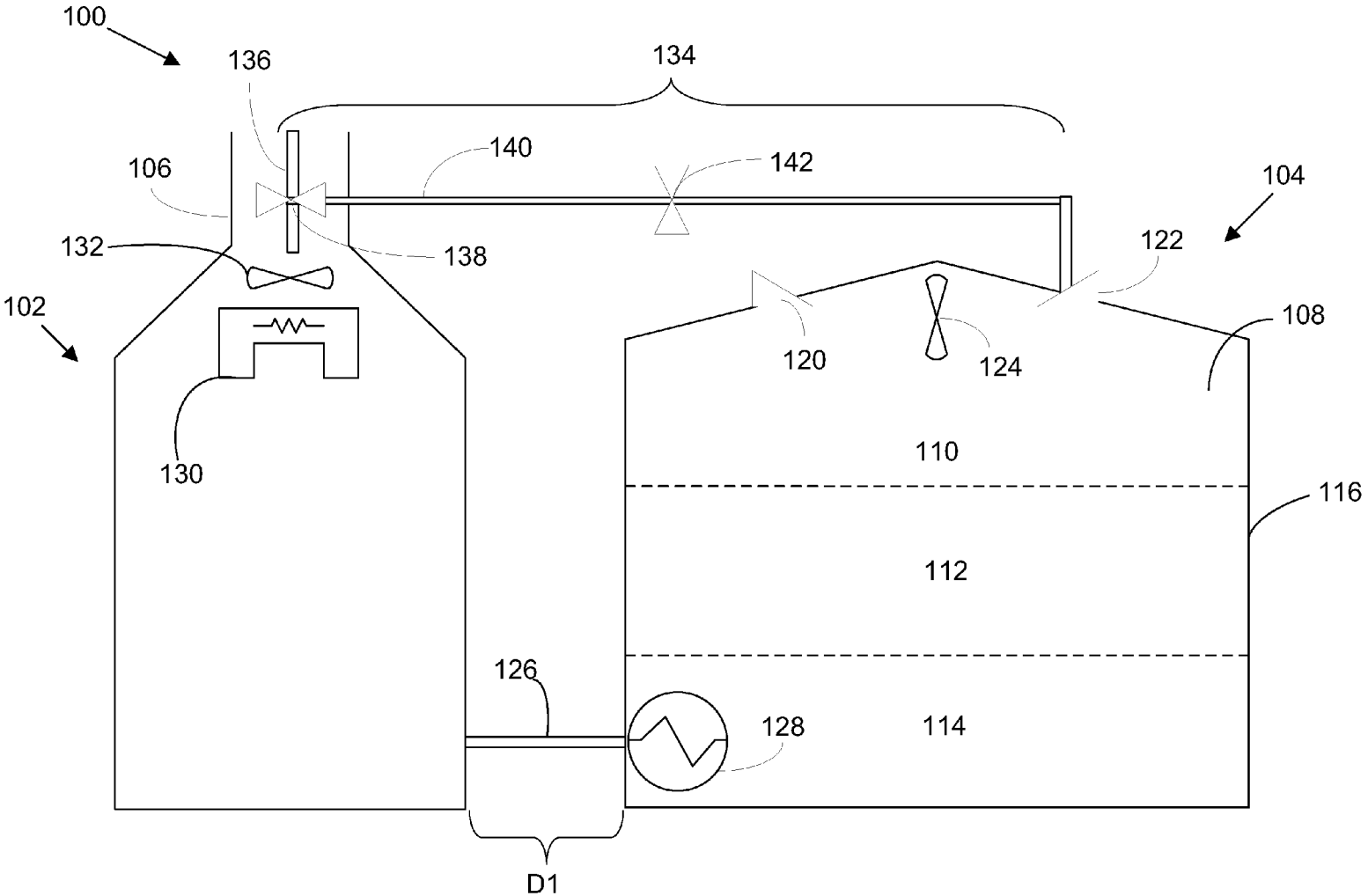
FIG. 1 is a schematic view of an embodiment of a system for drying wood products according to the disclosure.
Figure 2:
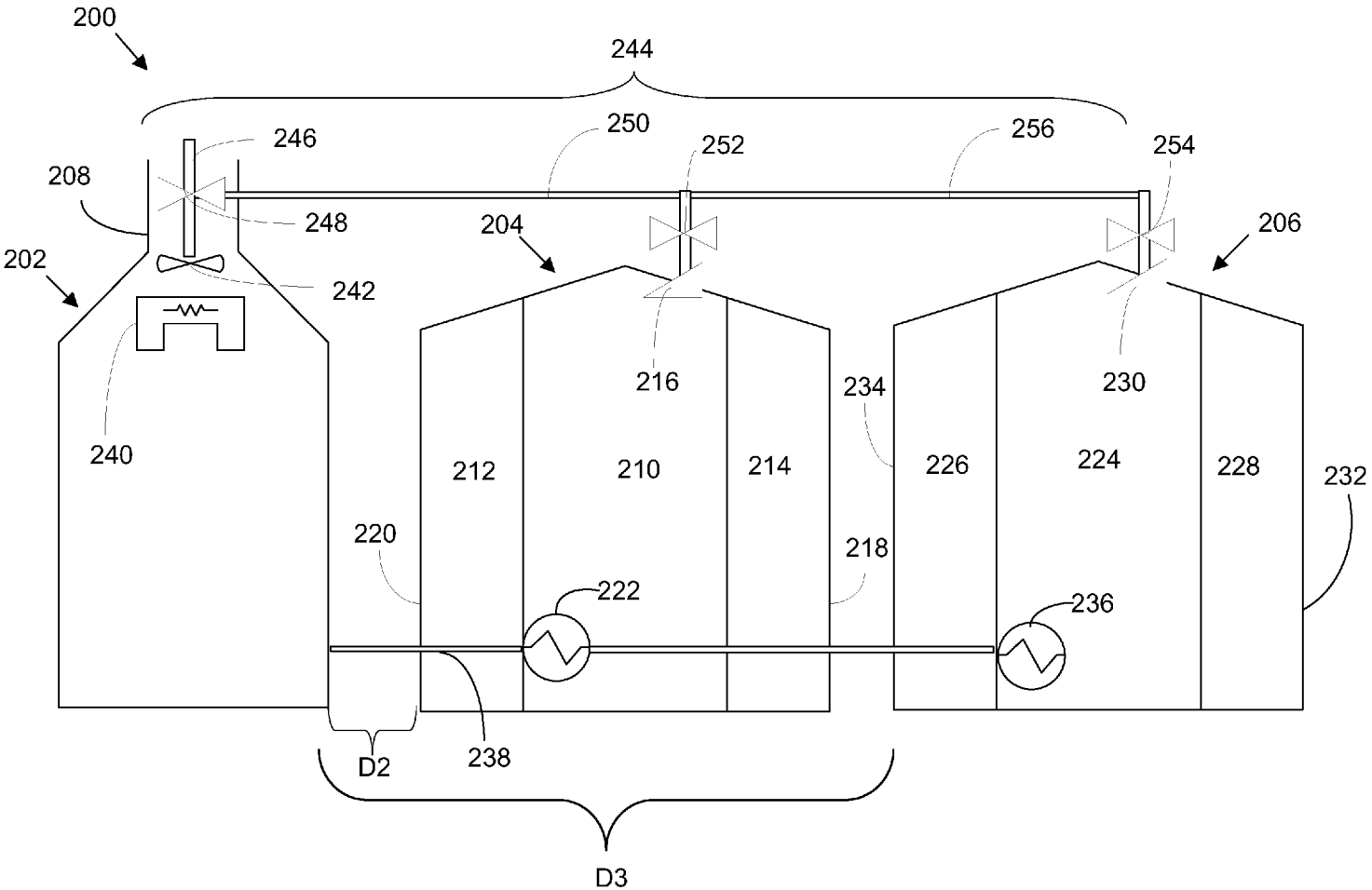
FIG. 2 is a schematic view of another embodiment of a system for drying wood products according to the disclosure.

Embodiments according to the disclosure may include a single kiln and/or a single combustion device. Alternatively, embodiments of the disclosure may include multiple kilns and/or multiple combustion devices. FIG. 1 depicts an embodiment of a system according to the disclosure involving a single kiln and a single combustion device. FIG. 2 depicts an embodiment of a system according to the disclosure involving multiple kilns and a single combustion device. Embodiments of systems and methods for drying wood products according to the disclosure will now be described in detail.

In FIG. 1, a system 100 for drying wood products includes a combustion device 102 and an indirect fired kiln 104. The indirect fired kiln 104 and the combustion device 102 are shown separated by a distance D1. In some embodiments, the distance D1 may range anywhere from approximately 50 feet to approximately 300 feet. A person of ordinary skill in the art will appreciate that other types of kilns, combustion devices, and configurations thereof may be substituted for the particular depictions in the FIG. 1.

Referring back to FIG. 1, the combustion device 102 may be, for example, a steam boiler, a water boiler, or a thermal fluid heater. Additionally other types of combustion devices that would be obvious to a person of ordinary skill in the art are envisioned as part of the disclosure. As shown in FIG. 1, the combustion device 102 has an exhaust stack 106 for discharging combustion products (e.g., flue gas).

The indirect fired kiln 104 shown in FIG. 1 is a batch kiln having a single chamber 108. Batch kilns are well known to a person of ordinary skill in the art; therefore, the specific structures and systems associated with batch kilns are not discussed in this disclosure. Examples of batch kilns suitable for use according to embodiments of the disclosure include lumber dry kilns commercially available from Wellons Fei Corporation. The indirect fired kiln 104 shown has three heating zones within the chamber 108: a first heating zone 110, a second heating zone 112, and a third heating zone 114. In other embodiments, indirect fired kilns may have different numbers of heating zones or heating zones configured in a manner other than that shown in FIG. 1. Temperature, air flow, and humidity are regulated within each heating zone according to methods well known to a person or ordinary skill in the art.

The indirect fired kiln 104 has an opening 116 for receiving wood products (not shown). In some embodiments, the opening 116 may be sealed by a door (not shown). The wood products may be delivered by a fork lift, a truck, or by any other method known to a person of ordinary skill in the art. A discharge vent 120 is arranged on the indirect fired kiln 104 to discharge humid air from the chamber 108. Fans or another mechanism (not shown) may also be employed to help force humid air out of the indirect fired kiln 104. The indirect fired kiln also has an inlet vent 122 arranged for receiving heated air. In some embodiments, a fan 124 may be used to suck air into the chamber 108. Although only a single fan 124 is shown, multiple fans may be installed. The discharge vent 120, inlet vent 122, and one or more fans (e.g., the fan 124) make up a ventilation system for the indirect fired kiln 104.

Methods for drying wood products using the system 100 include the step of firing a fuel in the combustion device 102. The fuel may be a natural gas, coal, oil, a bio residual fuel (e.g., hog fuel, pellets, shavings, sawdust, etc), or another type of heating fuel known to a person of ordinary skill in the art. Combustion of the fuel will produce a heated fluid and a flue gas. The heated fluid is transported in a first string of insulated piping 126 for circulation in a heating element 128 (e.g., a heat exchanger) in the chamber 108. Heat produced by the heating element 128 serves as a primary heat source for the indirect fired kiln 104. In some embodiments, heat produced by the heating element constitutes approximately 70% to 80% of the total heat source for the indirect fired kiln 104.

Flue gas produced during combustion is usually composed of carbon dioxide ($CO_2$) and water vapor as well as nitrogen and excess oxygen. In FIG. 1 (and in most conventional applications), a device such as an electrostatic precipitator 130 is used to remove particulates from the flue gas before it is sent up the exhaust stack 106. An induced draft fan 132 may be used to assist in forcing the flue gas up the exhaust stack 106.

In embodiments according to the disclosure a flue gas recovery mechanism 134 is used to recover an amount of flue gas before it is discharged up the exhaust stack 106. The flue gas recovery mechanism 134 in FIG. 1 includes a second string of insulated piping 136, a first damper 138, a third string of insulated piping 140, and a second damper 142. The first damper 138 controls flow of the flue gas between the second string of insulated piping 136 and the third string of insulated piping 140. The second string of insulated piping 136 directs the flue gas up the stack 106. The third string of insulated piping 140 directs the flue gas to the inlet vent 122 of the indirect fired kiln 104. In some embodiments, a fan may be installed in the third string of indirect piping 140 to help direct the flue gas. In some embodiments, the second damper 142 may be used to regulate flow of the flue gas recovered to the inlet vent 122. The recovered flue gas is then used as a secondary heat source for the indirect fired kiln 104. In some embodiments, the heat from the recovered flue gas constitutes approximately 20% to 30% of the total heat source for the indirect fired kiln 104.

Referring to FIG. 2, a system 200 for drying wood products includes a combustion device 202, a first indirect fired kiln 204, and a second indirect fired kiln 206. The first indirect fired kiln 204 and the combustion device 202 are shown separated by a distance D2. The second indirect fired kiln 206 and the combustion device 202 are shown separated by a distance D3 In some embodiments, the distances D2 and D3 may each range anywhere from approximately 50 feet to approximately 300 feet. A person of ordinary skill in the art will appreciate that other types of kilns, combustion devices, and configurations thereof may be substituted for the particular depictions in the FIG. 2.

The combustion device 202 may be, for example, a steam boiler, a water boiler, or a thermal fluid heater. Additionally other types of combustion devices that would be obvious to a person of ordinary skill in the art are envisioned as part of the disclosure. As shown in FIG. 2, the combustion device 202 has an exhaust stack 208 for discharging combustion products.

The first indirect fired kiln 204 and the second indirect fired kiln 206 are both continuous kilns. Continuous kilns are well known to a person of ordinary skill in the art; therefore, the specific structures and systems associated with continuous kilns are not discussed in this disclosure. An example of a continuous dry kiln is described, for example, in U.S. Published Patent Application No. 2006/0272172, which is hereby incorporated by reference. Additionally, in other embodiments according to the disclosure, the one or more of the indirect fired kilns could be batch kilns.

The first indirect fired kiln 204 shown has three chambers: a first main chamber 210, a first conditioning chamber 212, and a second conditioning chamber 214. Continuous kilns according to the disclosure may have different numbers of chambers or configurations of chambers that differ from those shown in FIG. 2. Additionally each of the chambers may have one or more heating zones in which temperature, air flow, and humidity are regulated according to methods well known to a person or ordinary skill in the art.

The ventilation system for the first indirect fired kiln 204 includes a first inlet vent 216, a first opening 218, and a second opening 220. In addition, other vent mechanisms and/or fans may be included as part of the ventilation system. The first inlet vent 216 is configured to let air into the first main chamber 210. The first opening 218 and the second opening 220 are the openings by which wood products are fed into the first indirect fired kiln 204. The openings serve the dual functions of allowing wood products to enter and exit the kiln and providing a mechanism for discharge of hot, humid air. Although not shown explicitly in FIG. 2, the ventilation system may also include one or more fans.

The first main chamber 210 is equipped with one or more heating elements. In FIG. 2, a first heating element 222 is shown. The first indirect fired kiln 204 operates by receiving wood products (not shown) through the first opening 218. The wood products move sequentially through the first conditioning chamber 212, the first main chamber 210, and the second conditioning chamber 214. The first heating element 222 provides a primary heat source to the first main chamber 210. Energy from exhaust gases in the first main chamber 210 and excess energy from the hot wood products moving through the kiln are used to heat the first conditioning chamber 212 and the second conditioning chamber 214. After the wood products move through the chambers, they exit the kiln at the second opening 220.

The second indirect fired kiln 206 may have generally the same structural and operational elements as are the first indirect fired kiln 204. The second indirect fired kiln 206 includes three chambers: a second main chamber 224, a third conditioning chamber 226, and a fourth conditioning chamber 228. The ventilation system for the second indirect fired kiln 206 includes a second inlet vent 230, a third opening 232, and a fourth opening 234. In addition, other vent mechanisms may be included as part of the ventilation system. The second inlet vent 230 is configured to let air into the second main chamber 224. The third opening 232 and the fourth opening 234 are the openings by which wood products are fed into the second indirect fired kiln 206. The openings serve the dual functions of allowing wood products to enter and exit the kiln and providing a mechanism for discharge of hot, humid air.

The second main chamber 224 is equipped with one or more heating elements. In FIG. 2, a second heating element 236 is shown. The second indirect fired kiln 206 operates by receiving wood products (not shown) through the third opening 232. The wood products move sequentially through the chambers. The second heating element 236 provides a primary heat source to the second main chamber 224. Energy from exhaust gases in the second main chamber 224 and excess energy from the hot wood products moving through the kiln are used to heat the other chambers. After the wood products move through the chambers, they exit the kiln at the fourth opening 234.

Methods for drying wood products using the system 200 are similar to the methods described with respect to FIG. 1. In some embodiments, the process begins by firing a fuel in the combustion device 202. The fuel may be a natural gas, coal, oil, a bio residual fuel (e.g., hog fuel, pellets, sawdust, shavings, etc) or another type of heating fuel known to a person of ordinary skill in the art. As described above, combustion of the fuel will produce a heated fluid and a flue gas. The heated fluid is transported in a first string of insulated piping 238 for circulation in the first heating element 222 and the second heating element 236.

In some embodiments, the combustion device 202 includes an electrostatic precipitator 240 for removing particulates from the flue gas before it is sent up the exhaust stack 208. An induced draft fan 242 may be used to assist in forcing the flue gas up the exhaust stack 208.

In embodiments according to the disclosure, a flue gas recovery mechanism 244 is used to recover an amount of flue gas before it is discharged up the exhaust stack 208. The flue gas recovery mechanism 244 in FIG. 2 includes a second string of insulated piping 246, a first damper 248, a third string of insulated piping 250, a second damper 252, a third damper 254, and a fourth string of insulated piping 256. The first damper 248 controls flow of the flue gas between the second string of insulated piping 246 and the third string of insulated piping 250. The second string of insulated piping 246 directs the flue gas up the stack 208. The third string of insulated piping 250 directs a first portion of the flue gas to the first inlet vent 216 of the first indirect fired kiln 204. In some embodiments, the second damper 252 may be used to regulate flow of the flue gas recovered to the first inlet vent 216. The fourth string of insulated piping 256 directs a second portion of the flue gas to the second inlet vent 230 of the second indirect fired kiln 206. In some embodiments, the third damper 254 may be used to regulate flow of the flue gas recovered to the second inlet vent 230. One or more fans (not shown) may also be arranged in the third string of insulated piping 250 and/or the fourth string of insulated piping 256 to facilitate flow of the flue gas. In some embodiments, the heat from the first portion of the recovered flue gas constitutes approximately 20% to 30% of the total heat source for the first indirect fired kiln 204. In some embodiments, the heat from the second portion of the recovered flue gas constitutes approximately 20% to 30% of the total heat source for the second indirect fired kiln 206.

From the foregoing, it will be appreciated that the specific embodiments of the disclosure have been described herein for purposes of illustration, but that various modifications may be made without deviating from the disclosure. For example, modifications to the kiln design and configurations that would be obvious to a person of ordinary skill in the art may be made. Although FIGS. 1 and 2 explicitly show a single combustion device, the use of multiple combustion devices is contemplated to be within the scope of the disclosure. Kiln and combustion device configurations that are different from those explicitly shown in FIGS. 1 and 2 may be used without departing from the spirit of the disclosure.

Aspects of the disclosure described in the context of particular embodiments may be combined or eliminated in other embodiments. For example, some of the features shown in embodiments using multiple kilns may be used in embodiments where only a single kiln is used. Further, while advantages associated with certain embodiments of the disclosure may have been described in the context of those embodiments, other embodiments may also exhibit such advantages, and not all embodiments need necessarily exhibit such advantages to fall within the scope of the disclosure. Accordingly, the invention is not limited except as by the appended claims.

The following examples will serve to illustrate aspects of the present disclosure. The examples are intended only as a means of illustration and should not be construed to limit the scope of the disclosure in any way. Those skilled in the art will recognize many variations that may be made without departing from the spirit of the disclosure.

Example

Modeling of Systems and Methods According to the Disclosure Compared to Conventional Methods Systems and methods according to embodiments of the disclosure were compared to conventional methods for drying wood products using modeling techniques. A model of the total energy balance for both a continuous kiln and a batch kiln was constructed. Lumber drying operations were simulated for each of the systems modeled. Exemplary models for the continuous kilns are shown in FIGS. 3-6.

Figure 3:
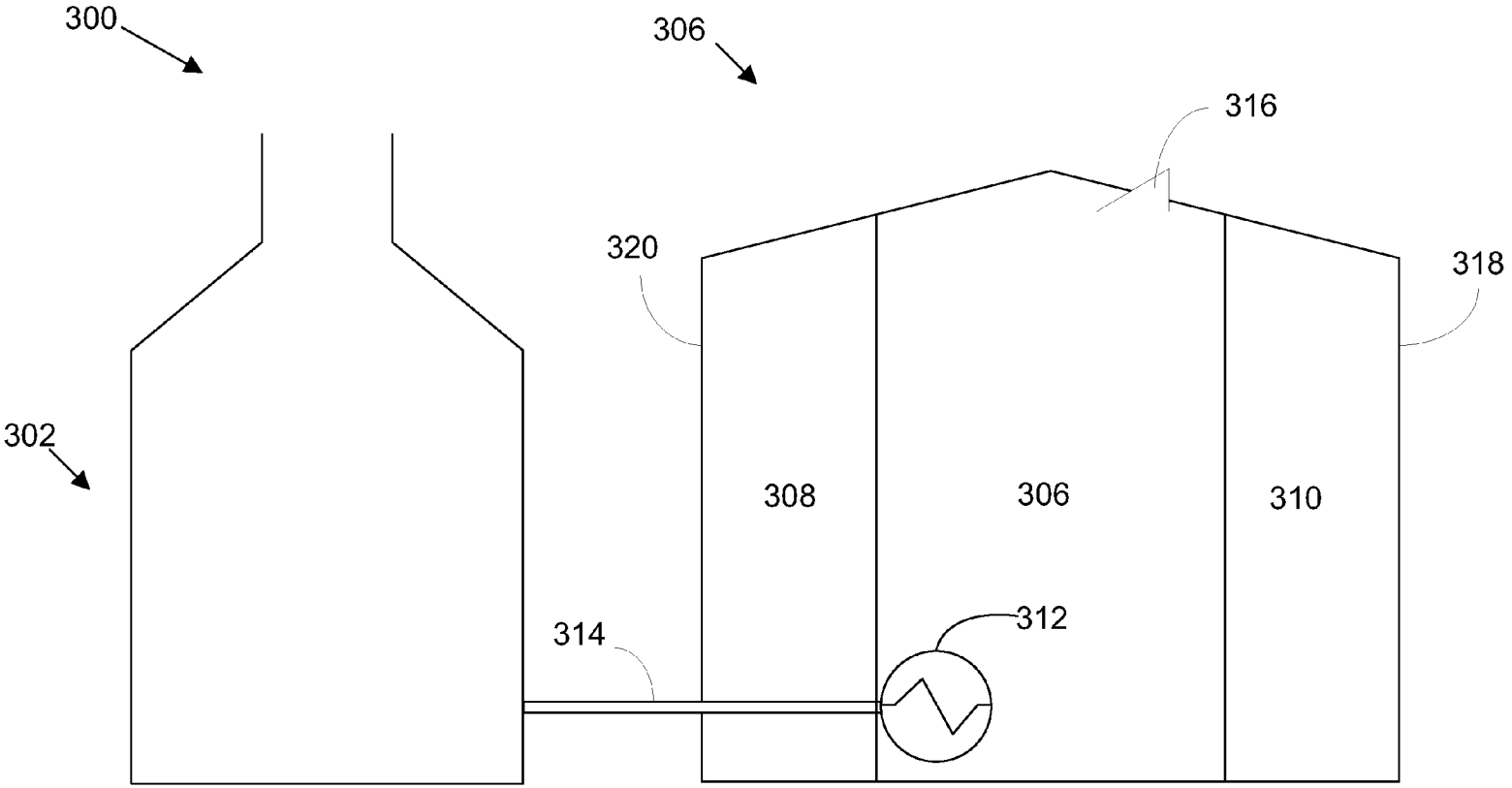
FIG. 3 (PRIOR ART)
FIG. 3 is a schematic view of a conventional system for drying wood products.

FIG. 3 is a schematic view of a conventional system 300 including a steam boiler 302 and an indirect fired continuous kiln 304. According to conventional methods, the indirect fired kiln 304 is heated solely by the steam boiler 302. The indirect fired kiln 304 modeled is a continuous kiln having three chambers: a main chamber 306, a first conditioning chamber 308, and a second conditioning chamber 310. A heat exchanger 312 provides the sole heat source to the indirect fired kiln 304. The heat exchanger 312 is connected to the steam boiler 302 via insulated piping 314. The indirect fired kiln's 304 ventilation system includes an inlet vent 316, a first opening 318, and a second opening 320.

Figure 4:
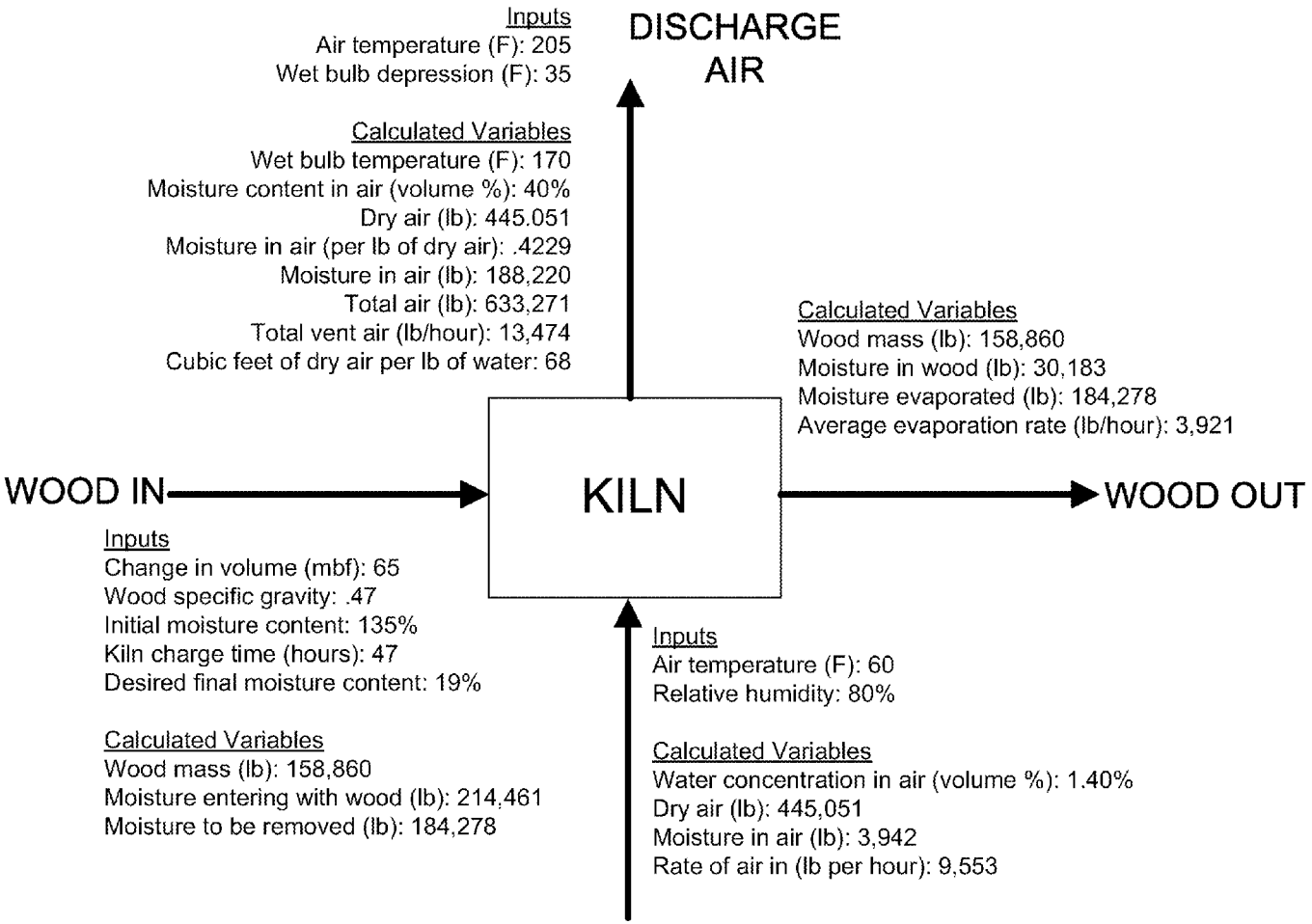
FIG. 4 (PRIOR ART)
FIG. 4 is a flow chart depicting a model of total energy balance for the system shown in FIG. 3.

The model was used to simulate drying of nearly 160,000 pounds of Hemlock lumber. FIG. 4 shows the input and results of the total energy balance model for the system in FIG. 3. The values inputted into the model and the calculated variables are shown in a flow chart configuration.

Figure 5:
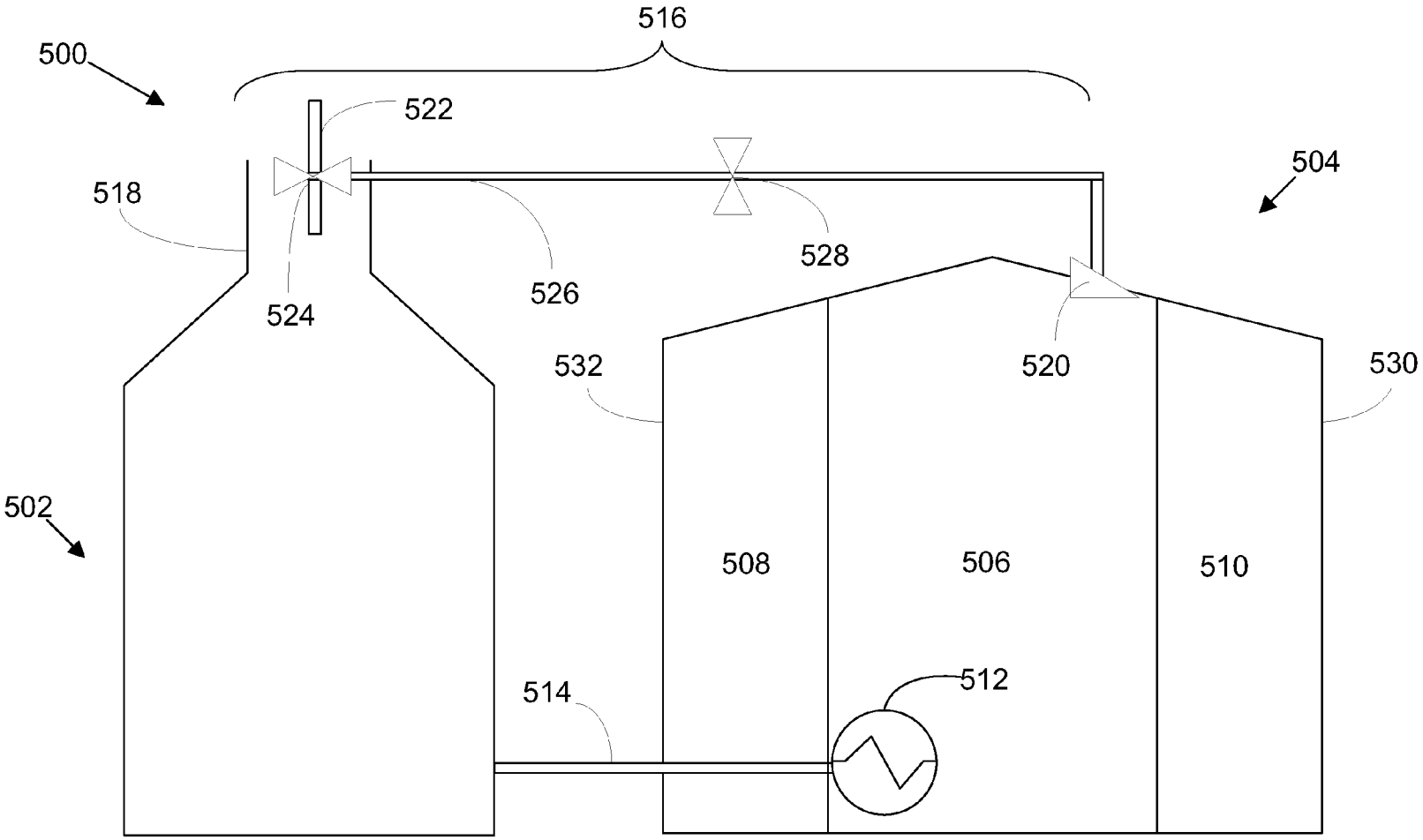
FIG. 5 is a schematic view of a system for drying wood products according to embodiments of the disclosure.

FIG. 5 is a schematic view of a system 500 for drying wood products according to embodiments of the disclosure. The system 500 includes a steam boiler 502 and an indirect fired kiln 504. According to embodiments of the disclosure, the primary heat source for the indirect fired kiln 504 is the steam boiler 502. The secondary heat source is recovered flue gas. The indirect fired kiln 504 modeled is a continuous kiln having three chambers: a main chamber 506, a first conditioning chamber 508, and a second conditioning chamber 510. A heat exchanger 512 provides a primary source of heat to the indirect fired kiln 504. The heat exchanger 512 is connected to the steam boiler 502 via insulated piping 514. A flue gas recovery mechanism 516 connects an exhaust stack 518 on the steam boiler 502 to an inlet vent 520 on the indirect fired kiln 504. In the embodiment shown, the flue gas recovery mechanism includes a first string of insulated piping 522, a first damper 524, a second string of insulated piping 526, and a second damper 528. The flue gas provides a secondary source of heat to the indirect fired kiln 504. The indirect fired kiln's 504 ventilation system also includes a first opening 530 and a second opening 532.

Figure 6:
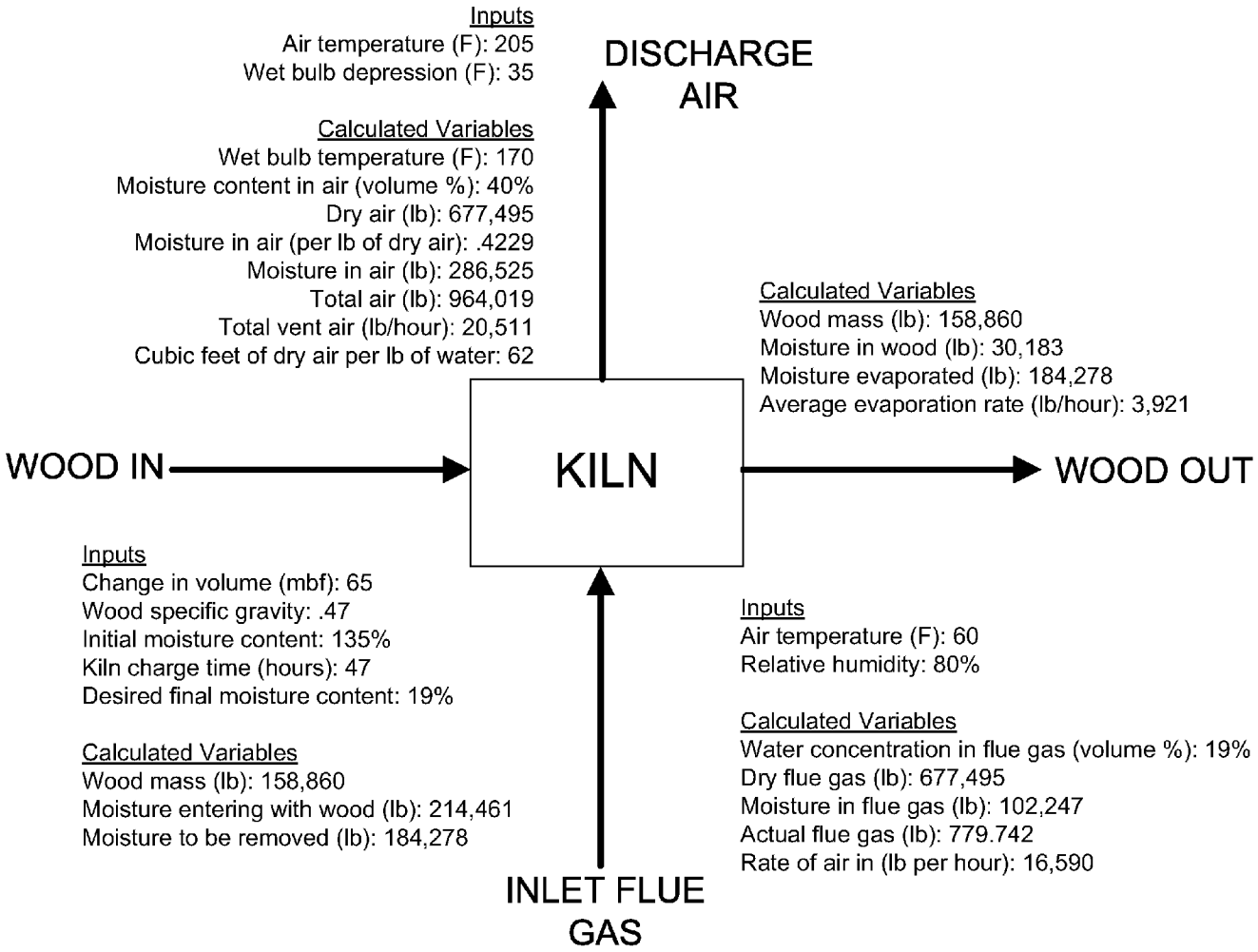
FIG. 6 is a flow chart depicting a model of the total energy balance for the system shown in FIG. 5.

The model was used to simulate drying of nearly 160,000 pounds of Hemlock lumber. FIG. 6 shows the input and results of the total energy balance model for the system in FIG. 5. The values inputted into the model and the calculated variables are shown in a flow chart configuration.

The results of the simulation show that systems and methods according to the disclosure provide a viable alternative method for drying wood products in kilns. Based upon the models, the amount of steam required to dry a fixed amount of lumber may be reduced using systems and methods according to the disclosure. In the case of a batch kiln, the reduction in steam required may be approximately 20%. In the case of a continuous kiln, the reduction in steam required may be approximately 37%. These results may differ based on the particular application and conditions; however, systems and methods according to the disclosure may be effective to save on energy and costs associated with constructing additional boilers and other equipment for drying wood products. Although the simulations were run using lumber as the wood product, systems are methods according to the disclosure are applicable to drying of wood products other than lumber.

I claim:

1. A method for drying wood products with recovered flue gas comprising the steps of:

providing an indirect fired kiln containing the wood products, the indirect fired kiln comprising:

one or more chambers;

one or more heating zones within the one or more chambers;

one or more heating elements located in the one or more chambers; and a ventilation system;

providing one or more combustion devices for heating a fluid in the one or more combustion devices, each of the one or more combustion devices comprising an exhaust stack, wherein the one or more combustion devices are selected from the group consisting of a steam boiler, a water boiler, and a thermal fluid heater;

providing a heat exchanger within the one or more chambers in fluid flow communication in the one or more combustion devices;

firing a fuel in the one or more combustion devices to heat the fluid and thereby producing a heated fluid and a flue gas from the one or more combustion devices;

transporting the heated fluid from the one or more combustion devices to the heat exchanger and circulating the heated fluid in and the heat exchanger, thereby providing a primary heat source to the kiln;

recovering an amount of the flue gas from the exhaust stack before the flue gas is discharged from the exhaust stack in each of the one or more combustion devices;

transferring the recovered flue gas to one or more of the ventilation systems to provide a secondary heat source to the indirect fired kiln; and drying the wood products in the indirect fired kiln, a total heat source for the indirect fired kiln is provided by the primary heat source and the secondary heat source, wherein the primary heat source provides approximately 70% of the total heat source to approximately 80% of the total heat source, and wherein the secondary heat source provides approximately 30% of the total heat source to approximately 20% of the total heat source.

2. The method of claim 1 wherein the indirect fired kiln is a continuous kiln or a batch kiln.

3. The method of claim 1 wherein the fuel in the one or more combustion devices is selected from the group consisting of: bio residual fuels, natural gas, coal, and oil.

4. The method of claim 1, wherein the step of transferring the amount of flue gas to the ventilation system to provide the secondary heat source to the indirect fired kiln includes providing insulated piping which connects the ventilation system of the indirect fired kiln to the one or more combustion devices.

5. The method of claim 4 wherein the step of transferring the amount of flue gas to the ventilation system to provide the secondary heat source to the indirect fired kiln further comprises equipping the insulated piping with one or more fans.

6. The method of claim 1, further comprising the step of:

regulating the amount of flue gas transferred to the ventilation system using one or more dampers.

7. A method for drying wood products with recovered flue gas comprising:

providing an indirect fired kiln containing the wood products, the indirect fired kiln including a chamber, a heat exchanger, and gas inlet;

providing a combustion device, wherein the combustion device is selected from the group consisting of a steam boiler, a water boiler, and a thermal fluid heater, and wherein the combustion device, when combusting, heats a fluid in the combustion device and produces a heated fluid and a heated flue gas produces a heated flue gas;

receiving wood products in the kiln chamber;

combusting the wood products in the combustion device;

transporting the heated fluid from the combustion device to the heat exchanger and circulating the heated fluid in the kiln heat exchanger to provide a primary heat source to the kiln chamber;

transferring heated flue gas from the combustion device to the kiln gas inlet to provide a secondary heat source to the kiln chamber, wherein a total heat source for the kiln is provided by the primary heat source and the secondary heat source and wherein the secondary heat source provides approximately 20% of the total heat source to approximately 30% of the total heat source; and drying the wood products in the kiln.

* * * * *